US009259101B2

(12) United States Patent
Xiao

(10) Patent No.: US 9,259,101 B2
(45) Date of Patent: Feb. 16, 2016

(54) MULTIFUNCTIONAL SPONGE SAFETY BABY WALKER

(76) Inventor: Bohong Xiao, Wuhan (CN)

( * ) Notice: Subject to any disclaimer, the term of this patent is extended or adjusted under 35 U.S.C. 154(b) by 241 days.

(21) Appl. No.: 13/637,474

(22) PCT Filed: Apr. 1, 2011

(86) PCT No.: PCT/CN2011/000564

§ 371 (c)(1),
(2), (4) Date: Sep. 26, 2012

(87) PCT Pub. No.: WO2011/120337

PCT Pub. Date: Oct. 6, 2011

(65) Prior Publication Data

US 2013/0023385 A1 Jan. 24, 2013

(30) Foreign Application Priority Data

Apr. 2, 2010 (CN) ..... 2010 1 0140204

(51) Int. Cl.
*A47D 13/04* (2006.01)

(52) U.S. Cl.
CPC ..... *A47D 13/04* (2013.01)

(58) Field of Classification Search
CPC ... A47D 13/043; A47D 13/04; A47D 13/107; A61H 3/008; A61H 3/00; A61H 2201/1633; A61H 2201/5061
USPC ..... 482/66; 280/87.021, 87.051; D12/130; 297/5; 135/67
See application file for complete search history.

(56) References Cited

U.S. PATENT DOCUMENTS

| | | | | | |
|---|---|---|---|---|---|
| 265,432 | A | * | 10/1882 | Peterson | 482/66 |
| 2,657,735 | A | * | 11/1953 | Hughes | 297/5 |
| 3,515,404 | A | * | 6/1970 | Perego | 280/87.051 |
| 3,884,495 | A | * | 5/1975 | Petock | 280/87.041 |
| 4,065,086 | A | | 12/1977 | Nakao | |
| 4,237,647 | A | * | 12/1980 | Shaw | 446/303 |
| 4,773,639 | A | * | 9/1988 | Graves | 482/66 |
| 4,901,898 | A | * | 2/1990 | Colombo et al. | 224/159 |
| 4,988,138 | A | * | 1/1991 | Danna et al. | 293/127 |

(Continued)

FOREIGN PATENT DOCUMENTS

| | | | |
|---|---|---|---|
| CN | 2166702 | Y | 6/1994 |
| CN | 2488400 | Y | 5/2002 |

(Continued)

OTHER PUBLICATIONS

State Intellectual Property Office of the P. R. China, "First Office Action", 201010140204.7, China, Apr. 30, 2014.

(Continued)

*Primary Examiner* — Loan H Thanh
*Assistant Examiner* — Andrew S Lo
(74) *Attorney, Agent, or Firm* — Tim Tingkang Xia, Esq.; Locke Lord LLP

(57) ABSTRACT

A multifunctional sponge safety baby walker comprises a body (1) and some support legs (3) located on the bottom of the body (1), wherein the body (1) is made of PU high density foaming material and can be made by molding, a manned hollow structure (2) is provided in the body (1), a cushion (4) for a stretching leg hole (4.1) is provided in the hollow structure (2), and the support legs (3) are slidable. The baby walker can be made into various animals and plants styles and art styles with cartoon child-taste, and also can be used as water recreation articles and building blocks.

3 Claims, 1 Drawing Sheet

(56) References Cited

U.S. PATENT DOCUMENTS

| | | | | |
|---|---|---|---|---|
| 5,040,556 | A * | 8/1991 | Raines | 135/67 |
| D340,210 | S * | 10/1993 | Veness | D12/130 |
| 5,518,475 | A * | 5/1996 | Garland | 482/68 |
| 5,732,961 | A * | 3/1998 | Theodoropoulos | 280/87.051 |
| 5,813,720 | A * | 9/1998 | Huang | 297/5 |
| 5,997,017 | A * | 12/1999 | Tilley | 280/87.021 |
| 6,626,487 | B1 * | 9/2003 | Buitendach | 297/153 |
| 7,017,924 | B1 * | 3/2006 | Lambert | 280/87.051 |
| 7,883,145 | B2 * | 2/2011 | Troutman et al. | 297/148 |
| 2003/0135954 | A1 * | 7/2003 | Beckwith | 16/422 |
| 2003/0184036 | A1 * | 10/2003 | Wu | 280/87.051 |
| 2004/0192516 | A1 * | 9/2004 | Buechel et al. | 482/66 |
| 2007/0170759 | A1 * | 7/2007 | Nolan et al. | 297/250.1 |

FOREIGN PATENT DOCUMENTS

| | | | |
|---|---|---|---|
| CN | 101297727 | A | 11/2008 |
| CN | 201879245 | U | 6/2011 |

OTHER PUBLICATIONS

State Intellectual Property Office of the P. R. China, "Second Office Action", 201010140204.7, China, Sep. 17, 2014

State Intellectual Property Office of the P. R. China, "Third Office Action", 201010140204.7, China, Dec. 29, 2014.

* cited by examiner

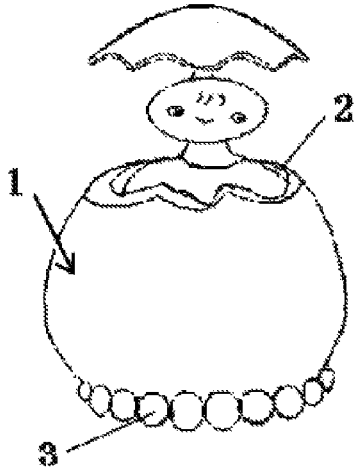
FIG. 1
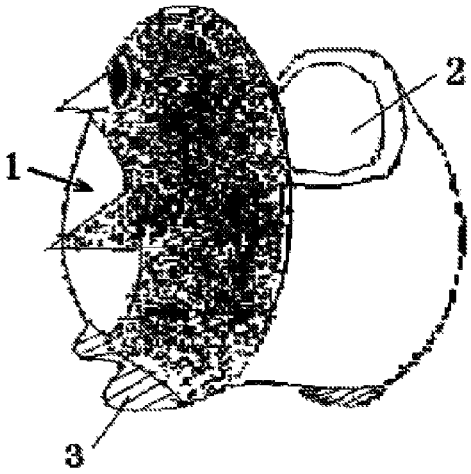
FIG. 2
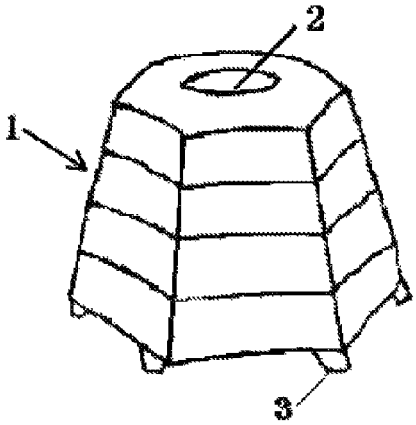
FIG. 3-A
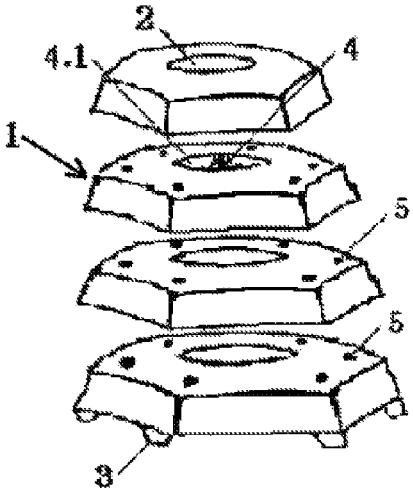
FIG. 3-B

MULTIFUNCTIONAL SPONGE SAFETY BABY WALKER

FIELD OF THE INVENTION

The present invention relates generally to a baby walker, and more particularly to a multifunctional sponge safety baby walker.

BACKGROUND OF THE INVENTION

A conventional baby walker is usually made of rigid materials such as steel and plastic, and has wheels mounted at the bottom of the walker. The conventional baby walker cannot be easily controlled. For example, when the walker is in use, the wheels may roll rapidly, thereby resulting in a large inertia impact. Consequently, the baby riding the walker may easily get bruised, hurt and/or stabbed.

Therefore, a heretofore unaddressed need exists in the art to address the aforementioned deficiencies and inadequacies.

SUMMARY OF THE INVENTION

In view of the above defects, the present invention is directed to a multifunctional sponge safety baby walker that has a simple structure, desired security, beautiful and childish design, and can be used as water recreation articles and toys of building blocks.

In one aspect of the present invention, the baby walker includes a body and a plurality of support legs located on a bottom of the body, where the body is made of a polyurethane (PU) high density foaming material and is formed by molding, a manned hollow structure is provided in the body, a cushion for a stretching leg hole is provided in the hollow structure, and the support legs are slidable.

In one embodiment, the body is an integrated structure.

In one embodiment, the body is a structure assembled by parts and blocks, which are assembled together through latches or connectors.

In one embodiment, the slidable legs are provided with one or more bells and/or collision flashing lights.

According to the present invention, the body is made of a sponge material and has a soft texture. The slidable legs, which are stable and capable of moving, are used to replace the wheels of a conventional baby walker, thereby removing the potential risks of the conventional baby walker due to large inertia impact generated by the rapid rolling speed of the wheels in use. Moreover, by using the slidable legs, a toddler can really excise independent, self-controlled and balanced walking. The body of the baby walker according to the present invention can further be used as water recreation articles and toys of building blocks, and thus is a multifunctional product having multiple uses.

In one embodiment, the body of the baby walker of the present invention can be made into various animal and/or plant styles with cartoon childish designs, which makes the baby walker look interesting and beautiful. According to the present invention, the baby walker can be used for baby walking and recreation.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

FIG. 1 shows schematically a baby walker according to one embodiment of the present invention.

FIG. 2 shows schematically a baby walker according to another embodiment of the present invention.

FIG. 3-A shows schematically a baby walker according to yet another embodiment of the present invention.

FIG. 3-B shows schematically an exploding view of the baby walker as shown in FIG. 3-A.

In FIGS. 1, 2, 3-A and 3-B, numeral reference "1" refers to a body, numeral reference "2" refers to a hollow structure, and numeral reference "3" represents a support leg. In FIG. 3-B, numeral reference "4" represents a cushion, numeral reference "4.1" represents a stretching leg hole, and numeral reference "5" represents a latch or connector.

DETAILED DESCRIPTION OF THE INVENTION

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings in FIGS. 1, 2, 3-A and 3-B. In accordance with the purposes of this invention, as embodied and broadly described herein, this invention, in one aspect, relates to a multifunctional sponge safety baby walker.

In the embodiments of the present invention, the baby walker includes a body 1 and a plurality of support legs 3 located on a bottom of the body 1. The body is formed to have a manned hollow structure 2. Additionally, the body 1 may have a cushion 4 for a stretching leg hole provided in the hollow structure 4.1. The support legs 3 are slidable.

The body 1 is made of a high density nontoxic foaming material, especially a PU high density foaming material, and is formed by a method such as molding. In one embodiment, the body 1 may be made of an integrated structure, as shown in FIG. 1, FIG. 2 and FIG. 3-A. In another embodiment, the body 1 may be made of a structure assembled by parts and blocks, which are assembled through latches or connectors 5, as shown in FIG. 3-B, and the parts of the assembled structure can be used as water recreation articles and building block toys. The shape of the body 1 may be integrally molded into various animal and/or plant styles or art styles with cartoon child-taste designs. According to the present invention, and may be designed into any shape as imagined, such as a newly hatched chicken, as shown in FIG. 1, a penguin, as shown in FIG. 2, and various shapes of animals, fruits, vegetables, vehicles, and ships. A manned hollow structure 2 is provided in the body 1, a cushion 4 for a stretching leg hole 4.1 is provided in the hollow structure 2, and support legs 3 are slidable legs integrated with the bottom of the body 1. In some embodiments, the slidable legs 3 are provided with several bells and/or collision flashing lights (not shown).

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A multifunctional sponge safety baby walker, comprising:

a plurality of blocks assembled together through latches or connectors thereby forming a body in a stacked configuration;

a plurality of support legs projecting from one of the blocks that forms a bottom of the body, wherein each of the blocks of the body and the support legs are made of a polyurethane high density foaming material that is formed by molding;

wherein a hollow structure is provided in the body and includes a cushion having a stretching leg hole positioned in the hollow structure; and wherein the support legs are integrally formed on the bottom of the body such that no movement between the support legs and the bottom of the body occurs, and the multifunctional sponge safety baby walker is slidable on a surface only through the support legs without wheels.

2. The multifunctional sponge safety baby walker according to claim 1, wherein the body is an integrated structure.

3. The multifunctional sponge safety baby walker according to claim 1, wherein the slidable support legs are provided with one or more bells and/or one or more collision flashing lights.

* * * * *